US009431715B1

(12) United States Patent
Bhattacharyya et al.

(10) Patent No.: US 9,431,715 B1
(45) Date of Patent: Aug. 30, 2016

(54) COMPACT WIDE BAND, FLARED HORN ANTENNA WITH LAUNCHERS FOR GENERATING CIRCULAR POLARIZED SUM AND DIFFERENCE PATTERNS

(71) Applicant: NORTHROP GRUMMAN SYSTEMS CORPORATION, Falls Church, VA (US)

(72) Inventors: Arun K. Bhattacharyya, Littleton, CO (US); Gregory P. Krishmar-Junker, Gardena, CA (US); Philip W. Hon, Hawthorne, CA (US); Shih-en Shih, Torrance, CA (US); David I. Stones, San Clemente, CA (US); Dah-Weih Duan, Torrance, CA (US); Loc Chau, Fullerton, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 14/818,122

(22) Filed: Aug. 4, 2015

(51) Int. Cl.
*H01Q 13/00* (2006.01)
*H01Q 13/02* (2006.01)
*H01Q 1/48* (2006.01)

(52) U.S. Cl.
CPC ..... *H01Q 13/02* (2013.01); *H01Q 1/48* (2013.01)

(58) Field of Classification Search
CPC ..... H01Q 13/02; H01Q 1/48; H01Q 13/025; H01Q 13/0258; H01Q 13/0266
USPC ..... 343/772, 786, 778
See application file for complete search history.

(56) References Cited

U.S. PATENT DOCUMENTS 3,680,145 A 7/1972 Beguin
6,094,175 A 7/2000 Alessi et al.
6,208,310 B1 3/2001 Suleiman et al.
6,271,799 B1 * 8/2001 Rief ..... H01Q 13/0258 343/776
6,441,795 B1 8/2002 Volman
6,535,174 B2 3/2003 Rao et al.
6,985,118 B2 1/2006 Zarro et al.

(Continued)

FOREIGN PATENT DOCUMENTS

JP S 53-68535 A 6/1978

OTHER PUBLICATIONS

Daniyan, O. L. et al. "Horn Antenna Design: The Concepts and Considerations" International Journal of Emerging Technology and Advanced Engineering, vol. 4, Issue 5, May 2014, pp. 706-708.

(Continued)

*Primary Examiner* — Hoanganh Le
(74) *Attorney, Agent, or Firm* — John A. Miller; Miller IP Group, PLC

(57) ABSTRACT

A flared feed horn including a plurality of signal lines deposited on a bottom surface of a substrate and forming part of a $TE_{11}$ sum mode launcher, a ground plane deposited a top surface of the substrate, and an outer conductor electrically coupled to the ground plane and having an internal chamber, where the conductor includes a flared portion and a cylindrical portion. The outer conductor includes an opening opposite to the substrate defining an aperture of the feed horn. The feed horn also includes an embedded conductor positioned within the chamber and being coaxial with the outer conductor, where the embedded conductor is in electrical contact with the plurality of signal lines. The feed horn also includes a $TE_{12}$ difference mode launcher electrically coupled to the outer conductor proximate the aperture.

20 Claims, 4 Drawing Sheets

(56) References Cited

U.S. PATENT DOCUMENTS

| | | | | |
|---|---|---|---|---|
| 7,463,207 | B1 | 12/2008 | Rao et al. | |
| 7,629,937 | B2 | 12/2009 | Lier et al. | |
| 8,154,463 | B2 | 4/2012 | Baliarda et al. | |
| 8,248,321 | B2 | 8/2012 | Anderson et al. | |
| 2002/0113745 | A1* | 8/2002 | Strickland | H01Q 13/0266 343/786 |
| 2002/0190911 | A1 | 12/2002 | Judasz | |
| 2011/0043422 | A1* | 2/2011 | Lin | H01P 1/173 343/756 |
| 2013/0141299 | A1* | 6/2013 | Mast | H05K 1/0278 343/786 |
| 2014/0285393 | A1* | 9/2014 | Biglarbegian | H01P 5/107 343/850 |

OTHER PUBLICATIONS

Banu, M. Ameena, "Design of Pyramidal Horn Antenna for UWB Applications" International Journal of Advanced Research in Computer and Communication Engineering, vol. 2, Issue 7, Jul. 2013, pp. 2671-2673.

* cited by examiner

COMPACT WIDE BAND, FLARED HORN ANTENNA WITH LAUNCHERS FOR GENERATING CIRCULAR POLARIZED SUM AND DIFFERENCE PATTERNS

GOVERNMENT CONTRACT

The Government of United States of America has rights in this invention pursuant to a U.S. Government contract.

BACKGROUND

1. Field

This invention relates generally to a flared antenna feed horn and, more particularly, to a flared antenna feed horn that includes a flared outer conductor, a microstrip-to-coaxial transition $TE_{11}$ sum mode launcher and a $TE_{12}$ difference mode launcher.

2. Discussion

For some communications applications, it is desirable to have a broadband system, namely, operation over a relatively wide frequency range, typically greater than 1.5:1. In some reflector based systems, it is desirable to have a feed with a small foot print, making it suitable for illuminating very low focal length to diameter ratio reflector lens.

In certain communications systems, signal tracking between the receiver and transmitter is achieved using a sum and difference radiation pattern. A sum pattern provides a broadside peak radiation pattern and a difference pattern provides a broadside null radiation pattern. In this case, two electromagnetic propagation modes, particularly the transverse-electric (TE) modes $TE_{11}$ and $TE_{12}$, are needed to realize a sum and difference within the same frequency range. System performance requirements may include a large instantaneous RF bandwidth and a small physical footprint, as well as other requirements.

A critical element to achieve the signal tracking feature, while meeting system specifications is the feed antenna. To meet desired size constraints, a smaller aperture size is usually required, such as that of an antenna feed horn. However, the cut-off frequency of the $TE_{12}$ difference mode of an antenna feed horn is about twice the cut-off frequency of the $TE_{11}$ sum mode, where the cut-off frequency of a particular mode is the lowest frequency that the mode can propagate. It is known in the art to load such a feed horn with a dielectric to lower the cut-off frequency of a particular mode. In addition to realizing the necessary modes for generating the sum and difference modes, ample signal from the feed horn must be transmitted or received. Namely, for a small aperture relative to the operating wavelength feed horn, there exists a significant impedance mismatch between the dielectric and free space resulting in significant signal loss.

DETAILED DESCRIPTION OF THE EMBODIMENTS

The following discussion of the embodiments of the invention directed to a broadband coaxial flared antenna feed horn providing sum and difference mode signals is merely exemplary in nature, and is in no way intended to limit the invention or its applications or uses.

Figure 1:
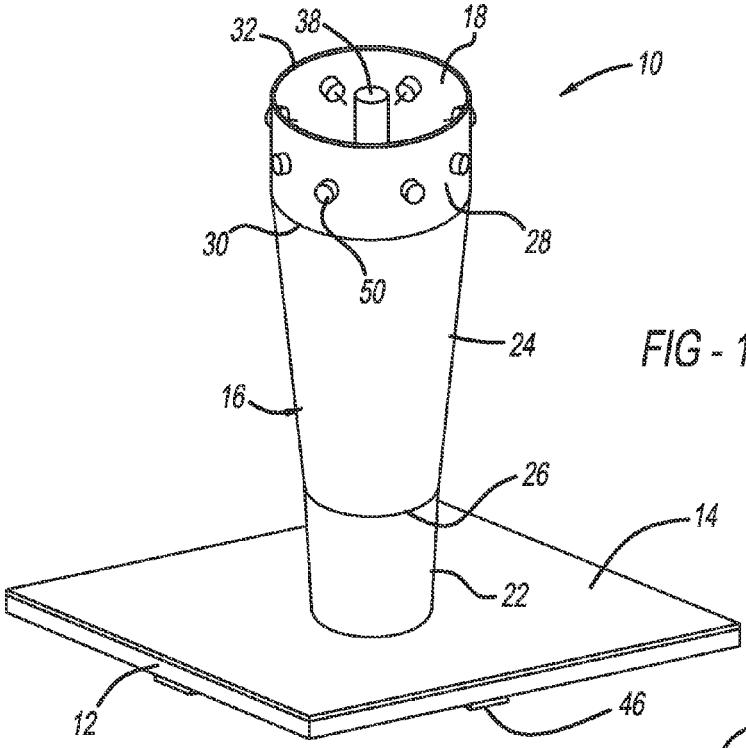
FIG. 1 is an isometric view of a coaxial flared antenna feed horn.
Figure 2:
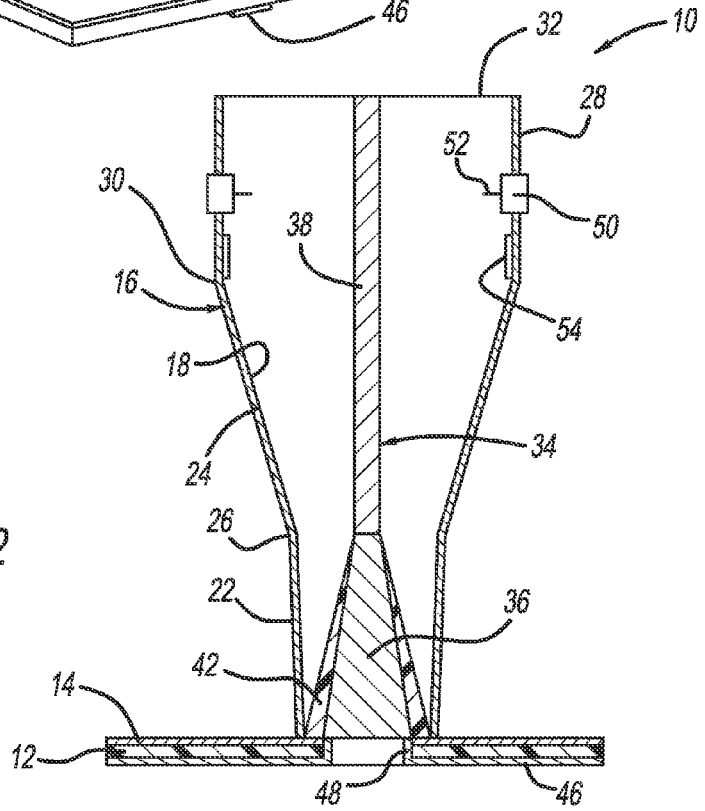
FIG. 2 is a cross-sectional view of the feed horn shown in FIG. 1.
Figure 3:
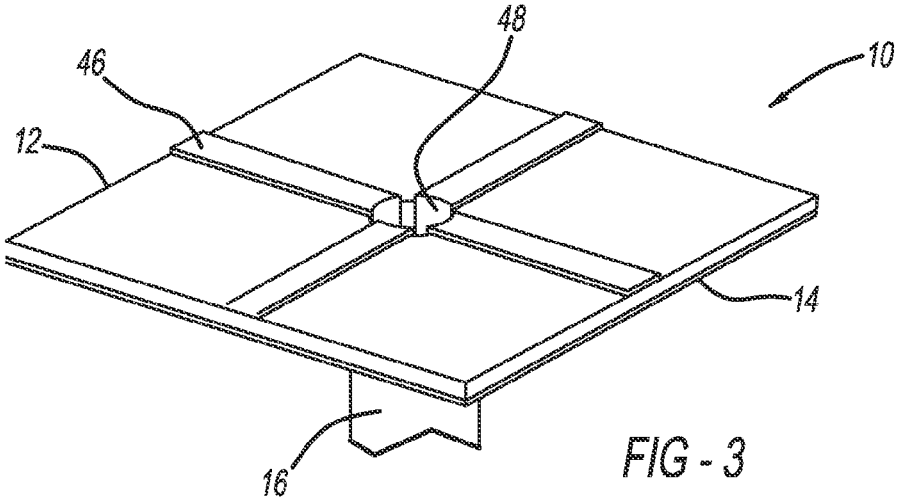
FIG. 3 is a cut-away, bottom isometric view of the feed horn shown in FIG. 1.

FIG. 1 is an isometric view, FIG. 2 is a cross-sectional view and FIG. 3 is a cut-away, bottom isometric view of a coaxial flared antenna feed horn 10 having the appropriate dimensions for providing certain antenna feed horn parameters and performance characteristics, for example, a height of about 2.2 inches, a diameter of about 0.66 inches, an operational frequency band of 17-53 GHz with a bandwidth ratio (BWR) of 3.12:1, a half-power beam width less than 70° over the band, and dual cross-polarization less than 15 dB. The conductive layers and dielectric materials discussed herein can be any suitable conductor, such as copper, and dielectric material.

The feed horn 10 includes a dielectric substrate 12, such as Rogers Duroid, having, for example, a relative dielectric constant $\in_r=3$. A conductive finite ground plane 14 is deposited on a top surface of the substrate 12 and is in electrical contact with an outer cylindrical ground conductor 16 defining a flared feed horn chamber 18 therein. A lower slightly tapered portion 22 of the conductor 16 is electrically coupled to the ground plane 14, where the taper of the portion 22 provides an impedance mismatch for a backward propagating mode at the location where the outer conductor 16 transitions to the ground plane 14. The tapered portion 22 transitions into a centered tapered portion 24 at interface 26 and the tapered portion 24 transitions into a uniform cylindrical portion 28 at transition 30, where an end of the cylindrical portion 28 defines an aperture 32 of the feed horn 10. The tapered portion 24 allows a gradual transition from the input of the horn 10 to the aperture 32. The length of the tapered portion 24 is adjusted to match the aperture impedance to the input waveguide impedance for the desired 3.12 to 1 bandwidth performance. The flared angle of the tapered portion 24 is small to avoid a large quadratic phase error on the aperture 32 that causes low aperture efficiency.

An embedded conductor 34 is provided within the chamber 18 and is coaxial with the ground conductor 16, where the embedded conductor 34 includes a lower conical section 36 having an opposite taper to the tapered portion 22 and having a length from the ground plane 14 to the transition 26, and an upper cylindrical section 38 that extends from the conical section 36 to the aperture 32 of the horn 10, and where the embedded conductor 34 can be a solid conductive piece or be hollow. The taper of the conical section 36 prevents higher order modes from propagating into the beam forming circuitry discussed below. A conical dielectric layer 42 is provided around the conical section 36, as shown.

Four microstrip feed lines 46 positioned at 90° relative to each other are deposited on a bottom surface of the substrate 12 opposite to the ground plane 14. In this non-limiting embodiment, four separate microstrip lines 48 are connected to the feed lines 46 and extend through the substrate 12 to be electrically connected to a lower end of the conical section 36 of the embedded conductor 34. Excitations signals applied to the microstrip lines 46 are properly phased to excite the $TE_{11}$ sum mode in the horn 10, which generates a circularly polarized sum pattern. It is noted that although the invention as described herein employs microstrip lines for mode launching, other embodiments may employ other types of signal lines that provide the desired E-field profile. The conical section 36 provides part of a microstrip-to-coaxial mode transformer or mode launcher that allows a signal on the microstrip feed lines 46 propagating in the microstrip transmission mode to be converted to the coaxial transmission mode. Particularly, the mode transformer or launcher section converts the coaxial $TE_{11}$ sum mode to a quasi-TEM microstrip mode, where the mode transformer section essentially acts as a transition from the coaxial mode to the microstrip mode. The radius of the embedded conductor 34 is gradually increased in such a way that the coaxial modal field lines resemble that of a microstrip field. This allows wide band impedance matching between the mode launcher and the feed horn 10.

Eight equally spaced electrical coaxial signal launchers 50 are coupled to the uniform section 28 of the outer conductor 16 and provide signal launchers for the $TE_{12}$ difference mode, where the signal launchers 50 each include a center signal pin 52 being a center conductor of a coaxial line extending into the chamber 18 that receive an excitation signal, and where the signal launchers 50 would be coupled to coaxial signal lines (not shown). The difference mode is selected as the $TE_{12}$ mode because that mode is the most appropriate mode for producing difference patterns with circular polarization. A portion of the $TE_{12}$ modal power that initially travels downward in the horn 10 reflects back from the tapered portion 24. For some frequencies the reflected power is out-of-phase with the outward horn power. As a result a severe impedance mismatch occurs for the $TE_{12}$ difference mode launchers. To address this mismatch problem, a low loss dielectric strip 54 is formed on an inside surface of the uniform portion 28 just above the transition 30 that reduces the intensity of the reflected waves and as a result a complete mismatch for the $TE_{12}$ difference mode signal launchers does not occur.

Figure 4:
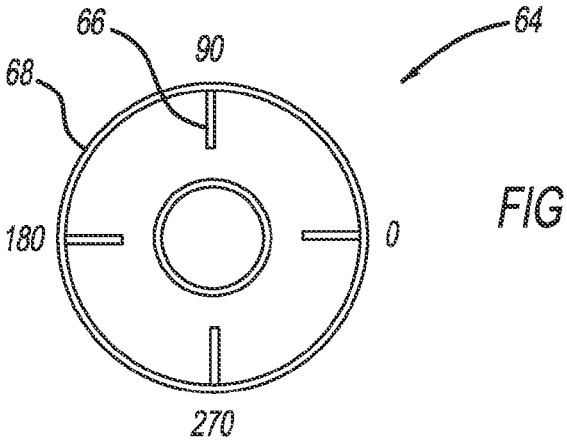
FIG. 4 is an illustration showing circularly polarized signal excitation for a $TE_{11}$ sum mode.

In order to generate propagation of the $TE_{11}$ sum mode as described, a constant amplitude phase changing excitation signal is applied to the microstrip lines 46. To illustrate this, FIG. 4 shows a signal excitation system 64 including electrical terminals 66 representing the lines 46 provided at positions 0°, 90°, 180° and 270° around an outer conductor 68 and to which the $TE_{11}$ sum mode excitation signal is selectively applied in rotation.

Figure 5:
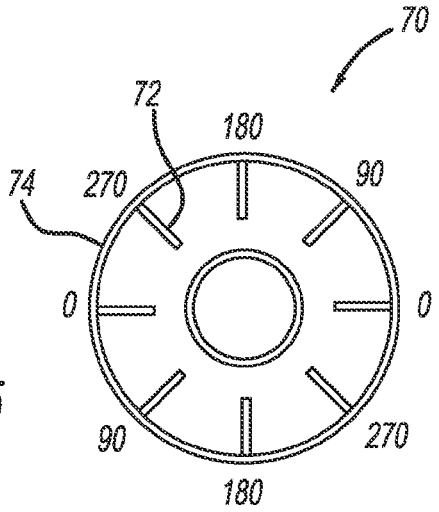
FIG. 5 is an illustration showing circularly polarized signal excitation for a $TE_{12}$ difference mode.

In order to generate propagation of the $TE_{12}$ difference mode as described, a constant amplitude phase changing excitation signal is applied to the signal launchers 50. To illustrate this, FIG. 5 shows a signal excitation system 70 including electrical terminals 72 representing the signal launchers 50 provided at positions 0°, 90°, 180°, 270°, 0°, 90°, 180° and 270° around an outer conductor 74 and to which the $TE_{12}$ difference mode excitation signal is selectively applied in rotation.

Figure 6:
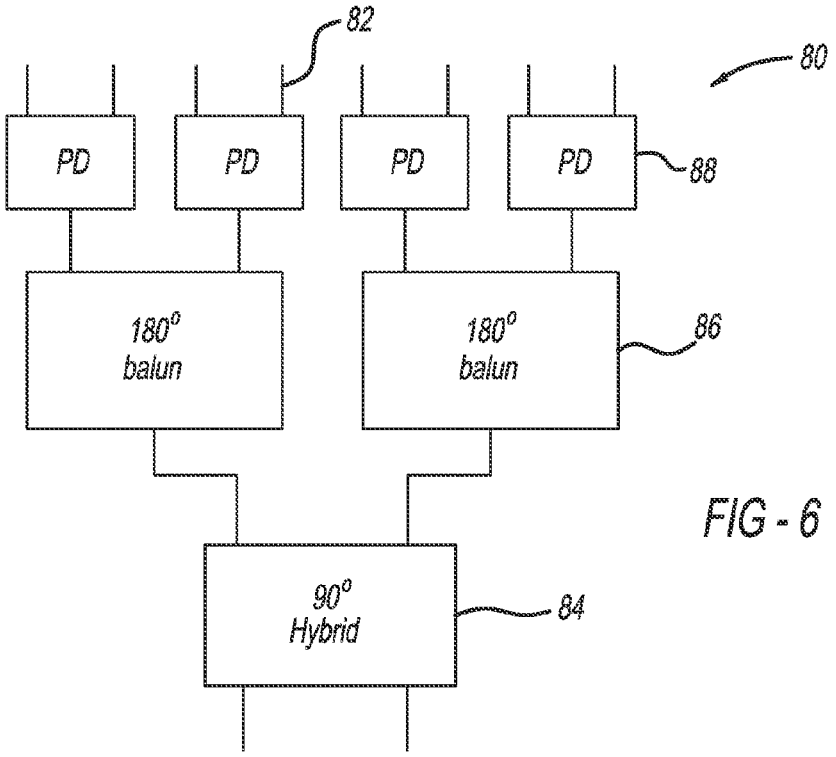
FIG. 6 is a block diagram of a beam forming network for the $TE_{12}$ difference mode launcher for the feed horn shown in FIG. 1.

Any suitable excitation circuitry can be used to generate the signals for the $TE_{12}$ difference mode and the $TE_{11}$ sum mode. FIG. 6 is a block diagram of a beam forming network 80 that provides the excitation signals to the mode launcher for the $TE_{12}$ difference mode as one non-limiting example, where phased controlled output signals on lines 82 are provided to each one of the signal launchers 50. A right hand circularly polarized signal (RHCP) and a left hand circularly polarized (LHCP) signal are applied to the input ports of a 90° hybrid coupler 84 that provides a 90° phase shift between the signals. The phase shifted output signals from the 90° hybrid coupler 84 are provided to two 180° baluns 86 that each provide 180° phase shifted signals to phase delay (PD) devices 88 that provide the 0°, 90°, 180°, 270°, 0°, 90°, 180° and 270° phase shifted signals to the $TE_{12}$ difference mode launcher, such as shown in the system 70.

Figure 7:
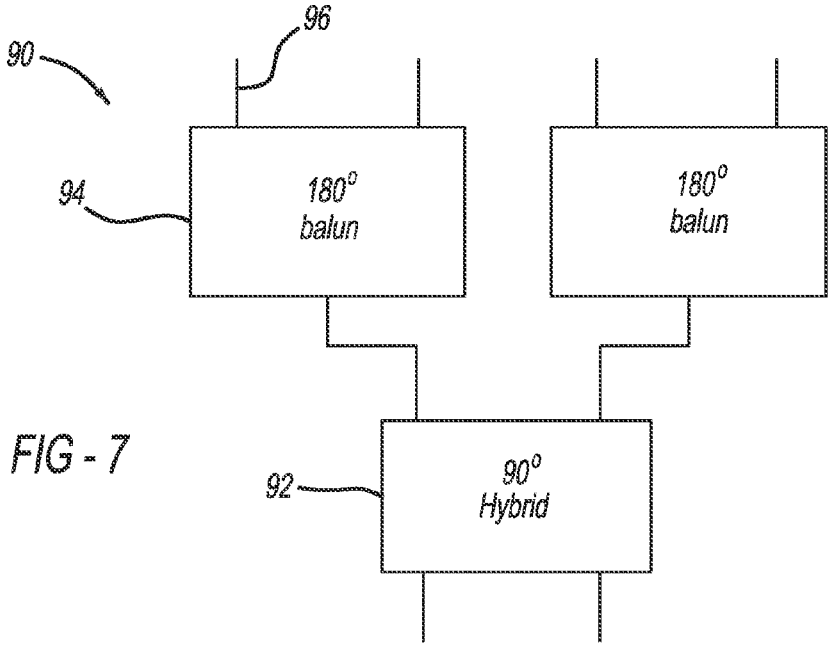
FIG. 7 is a block diagram of a beam forming network for the $TE_{11}$ sum mode launcher for the feed horn shown in FIG. 1.

FIG. 7 is a block diagram of a beam forming network 90 that provides the signals to the microstrip lines 46 for the $TE_{11}$ sum mode launcher. The beam forming network 90 includes a 90° hybrid coupler 92 that receives an RHCP signal and an LHCP signal and provides a 90° phase shift between these signals. The phase shifted output signals from the 90° hybrid coupler 92 are provided to two 180° baluns 94 that provide the 0°, 90°, 180° and 270° phase shifted signals to the $TE_{11}$ sum mode launcher, such as shown in the system 64.

Figure 8:
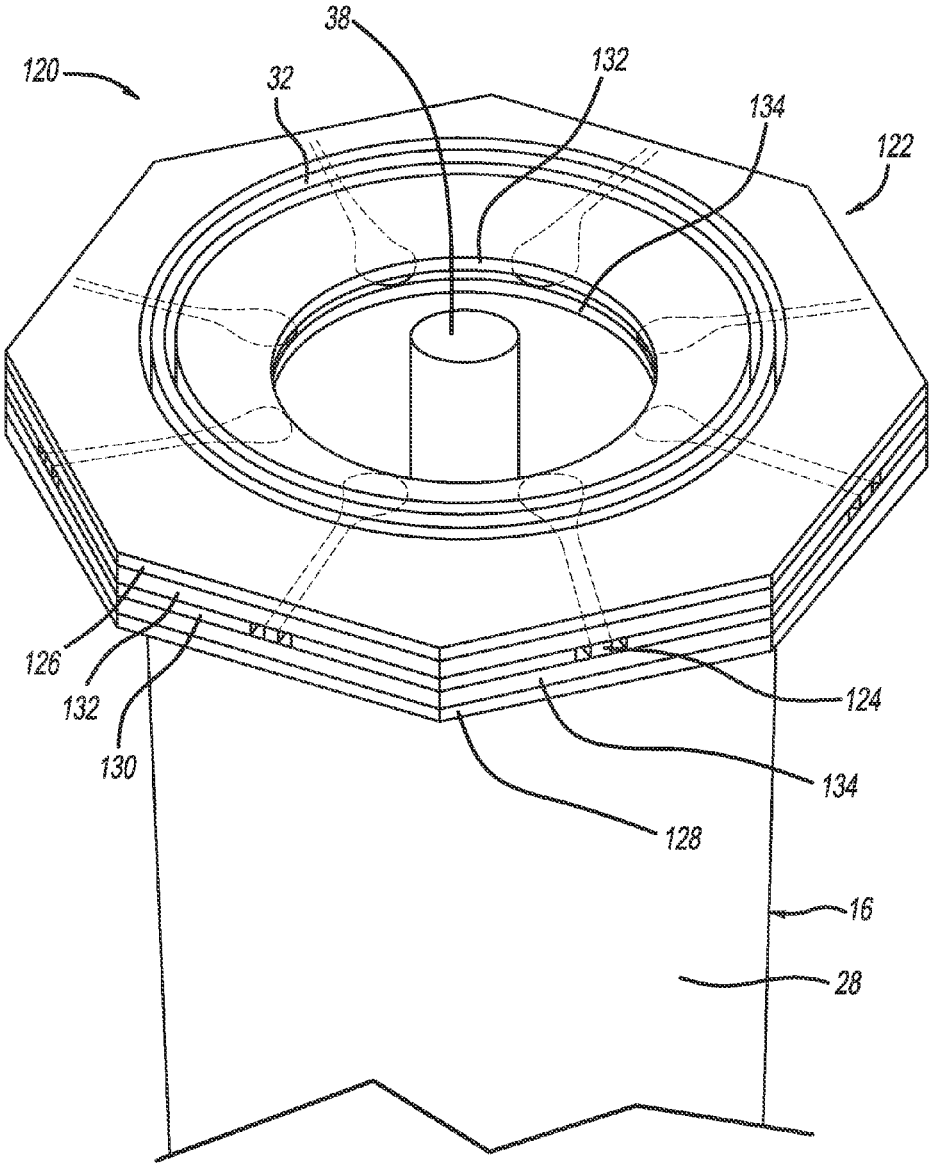
FIG. 8 is a cut-away, isometric view of a coaxial flared antenna feed horn including a coplanar waveguide $TE_{12}$ difference mode launcher.

Although the horn 10 includes the signal launchers 50 that are excited to launch the $TE_{12}$ difference mode, it will be clear to those skilled in the art that other signal excitation techniques can be employed to give the desired E-field profile for the $TE_{12}$ difference mode. To illustrate another example, FIG. 8 shows a cut-away, isometric view of a feed horn 120 similar to the feed horn 10, where like elements are identified by the same reference number. The feed horn 120 includes a grounded coplanar waveguide (CPW) 122 mounted to the cylindrical portion 28 proximate the aperture 32, as shown, that operates as the $TE_{12}$ difference mode launcher instead of the signal launchers 50. The CPW 122 includes eight excitation pins 124 having a general "teardrop" shape, where the teardrop shape is by way of a non-limiting example to provide improved bandwidth where other shapes may be applicable. The CPW 122 includes an upper conductive layer 126, a lower conductive layer 128 and a center ground plane 130, where the center ground plane 130 is electrically isolated from each of the signal pins 124. A top dielectric layer 132 is sandwich between the top conductor 126 and the ground plane 130 and a bottom dielectric layer 134 is sandwich between the ground plane 130 and the lower conductive layer 128. Each of the conductive layers 126 and 128 and the ground plane 130 end at an outside surface of the conductor 16 and are electrically coupled thereto. The signal pins 124 extend through the outer wall of the conductor 16 and are electrically isolated therefrom. The dielectric layers 132 and 134 also extend through the conductor 16 into the chamber 18. Any suitable signal line, such as coaxial cable (not shown), can be electrically coupled to the signal pins 124, where the outer conductor of the coaxial cable would be electrically coupled to the ground plane 130 and the center conductor of each coaxial cable would be electrically coupled to one of the pins 124.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A flared feed horn comprising:

a dielectric substrate including a top surface and a bottom surface;

at least one microstrip feed line deposited on the bottom surface of the substrate;

a ground plane deposited on the top surface of the substrate;

an outer conductor electrically coupled to the ground plane and including an internal chamber, said outer conductor including an opening opposite to the substrate defining an aperture of the feed horn, said outer conductor including a first tapered portion electrically coupled to the ground plane, a second tapered portion transitioning from the first tapered portion and having a greater taper than the first tapered portion, and a cylindrical portion transitioning from the second tapered portion and ending at the horn aperture;

an embedded conductor positioned within the chamber and being coaxial with the outer conductor, said embedded conductor including a conical section in electrical contact with the at least one microstrip line and a cylindrical section opposite to the substrate; and a signal mode launcher electrically coupled to the outer conductor proximate the aperture.

2. The feed horn according to claim 1 wherein the signal mode launcher is a difference mode launcher.

3. The feed horn according to claim 2 wherein the difference mode launcher is a $TE_{12}$ difference mode launcher.

4. The feed horn according to claim 2 wherein the signal mode launcher includes eight signal launcher pins extending into the internal chamber.

5. The feed horn according to claim 4 wherein the signal pins are inner conductors of a coaxial coupler.

6. The feed horn according to claim 4 wherein the signal pins are conductors in a coplanar waveguide.

7. The feed horn according to claim 2 further comprising a low loss dielectric formed to an inner surface of the cylindrical portion that provides impedance mismatch correction for the difference mode.

8. The feed horn according to claim 1 wherein a signal propagating on the at least one microstrip line is circularly polarized, and wherein the conical section has a taper selected to provide impedance matching of the signal from a microstrip mode to a coaxial mode.

9. The feed horn according to claim 1 wherein the at least one microstrip feed line is four feed lines oriented 90° apart.

10. The feed horn according to claim 9 wherein the feed lines are part of a sum mode launcher that launches a $TE_{11}$ sum mode.

11. The feed horn according to claim 1 further comprising a dielectric layer formed around the conical section within the chamber.

12. A flared feed horn comprising:

a dielectric substrate including a top surface and a bottom surface;

a plurality of signal lines deposited on the bottom surface of the substrate and forming part of a $TE_{11}$ sum mode launcher;

a ground plane deposited on the top surface of the substrate;

an outer conductor electrically coupled to the ground plane and including an internal chamber, said outer conductor including an opening opposite to the substrate defining an aperture of the feed horn, said outer conductor including a flared portion and a cylindrical portion;

an embedded conductor positioned within the chamber and being coaxial with the outer conductor, said embedded conductor being in electrical contact with the plurality of signal lines; and a $TE_{12}$ difference mode launcher electrically coupled to the outer conductor proximate the aperture.

13. The feed horn according to claim 12 wherein the difference mode launcher includes eight signal launcher pins extending into the internal chamber.

14. The feed horn according to claim 13 wherein the signal pins are inner conductors of a coaxial coupler.

15. The feed horn according to claim 13 wherein the signal pins are conductors in a coplanar waveguide.

16. The feed horn according to claim 12 further comprising a low loss dielectric formed to an inner surface of the cylindrical portion that provides impedance mismatch correction for the difference mode.

17. The feed horn according to claim 12 wherein the plurality of signal lines is four signal lines oriented 90° apart.

18. A flared feed horn comprising:

a dielectric substrate including a top surface and a bottom surface;

four microstrip feed lines deposited on the bottom surface of the substrate and being oriented 90° apart, said microstrip feed lines forming part of a $T_{E11}$ sum mode launcher;

a ground plane deposited on the top surface of the substrate;

an outer conductor electrically coupled to the ground plane and including an internal chamber, said outer conductor including an opening opposite to the substrate defining an aperture of the feed horn, said outer conductor including a first tapered portion electrically coupled to the ground plane, a second tapered portion transitioning from the first tapered portion and having a greater taper than the first taper portion, and a cylindrical portion transitioning from the second tapered portion and ending at the horn aperture;

an embedded conductor positioned within the chamber and being coaxial with the outer conductor, said embedded conductor including a conical section in electrical contact with the at least one microstrip line and a cylindrical section opposite to the substrate;

a $TE_{12}$ difference mode launcher electrically coupled to the outer conductor proximate the aperture, wherein the signal mode launcher includes eight signal launcher pins extending into the internal chamber; and a low loss dielectric formed to an inner surface of the cylindrical portion that provides impedance mismatch correction for the difference mode.

19. The feed horn according to claim 18 further comprising a dielectric layer formed around the conical section within the chamber.

20. The feed horn according to claim 18 wherein a signal propagating on the microstrip feed lines is circularly polarized, and wherein the conical section has a taper selected to provide impedance matching of the signal from a microstrip mode to a coaxial mode.

* * * * *